US005816031A

United States Patent [19]

Marshall

[11] Patent Number: 5,816,031

[45] Date of Patent: Oct. 6, 1998

[54] SADDLE CINCH

[75] Inventor: Robert L. Marshall, Salem, Ky.

[73] Assignee: Bob Marshall Enterprises, Inc., Salem, Ky.

[21] Appl. No.: 610,045

[22] Filed: Mar. 4, 1996

Related U.S. Application Data

[63] Continuation-in-part of Ser. No. 29,447, Oct. 6, 1994, Pat. No. Des. 367,738.

[51] Int. Cl.[6] ..... B68C 1/14

[52] U.S. Cl. ..... 54/23

[58] Field of Search ..... 54/23, 47

[56] References Cited

U.S. PATENT DOCUMENTS

| | | | |
|---|---|---|---|
| 42,015 | 3/1864 | Nichols . | |
| 204,507 | 6/1878 | Ryerson | 54/38.1 |
| 316,613 | 4/1885 | Farr | 54/23 |
| 320,118 | 6/1885 | Eckles . | |
| D. 367,738 | 3/1996 | Marshall | D30/134 |
| 485,481 | 11/1892 | Tileston . | |
| 541,055 | 6/1895 | Reamy | 54/38.1 |
| 755,304 | 3/1904 | Miller | 54/38.1 |
| 909,385 | 1/1909 | Fachiri . | |
| 3,805,491 | 4/1974 | Deal | 54/23 |
| 3,828,521 | 8/1974 | Dalaney | 54/23 |
| 3,835,621 | 9/1974 | Gorenschek . | |
| 4,287,705 | 9/1981 | Frost et al. . | |
| 4,434,604 | 3/1984 | Bird | 54/23 |
| 4,570,424 | 2/1986 | Simpson | 54/23 |
| 4,800,709 | 1/1989 | Le Tixerant | 54/66 X |
| 4,821,380 | 4/1989 | Crosby | 54/23 |
| 4,905,458 | 3/1990 | Johnston et al. | 54/23 |
| 5,018,340 | 5/1991 | Marshall | 54/66 X |
| 5,031,387 | 7/1991 | Rider | 54/23 |
| 5,125,219 | 6/1992 | Sligo | 54/23 |
| 5,134,836 | 8/1992 | Harty | 54/23 |
| 5,187,924 | 2/1993 | Marshall | 54/44.5 |
| 5,426,924 | 6/1995 | Harty | 54/23 |

FOREIGN PATENT DOCUMENTS

| | | | |
|---|---|---|---|
| 77295 | 8/1919 | Austria . | |
| 404741 | 12/1918 | Germany . | |
| 2173 | of 1881 | United Kingdom . | |
| 3318 | 7/1883 | United Kingdom . | |
| 7464 | of 1898 | United Kingdom . | |
| 7296 | of 1905 | United Kingdom | 54/23 |

*Primary Examiner*—Robert P. Swiatek
*Attorney, Agent, or Firm*—David W. Carrithers

[57] ABSTRACT

A cinch for securing a saddle to a horse. The cinch utilizes a generally rigid "U-shaped" rib support member composed of a stiff polymer in combination with padding such as neoprene, filler material, and/or leather covering the rib, and a means of attaching the cinch to a saddle. The cinch is designed to give added comfort to the horse, greater safety, stability, and control to the rider.

16 Claims, 6 Drawing Sheets

SADDLE CINCH

This application is a Continuation-In-Part of U.S. Pat. application Ser. No. 29/029,447 filed on Oct. 6, 1994, and now U.S. Pat. No. Des. 367,738.

BACKGROUND OF THE INVENTION

This invention relates generally to saddles that are used for riding horses, and more particularly to a saddle cinch for tightening the saddle to the horse. Typically a saddle for the rider is placed upon the back of a horse and is cinched to the horse by the use of a cinch or girth. Typically, western type saddles have rigging for employing both a front cinch and a flank cinch. The front cinch typically is conventionally a flat piece of several strands of soft rope which may be four or five inches wide and may be about fifteen to sixteen inches long which extends under the rib cage of the horse and is connected to the cinch strap of the saddle on the near-side (left side as viewed by rider) and the off strap on the off-side (right side as viewed by the rider). One end of the girth is connected to one side of the saddle with a leather strip. The other end of the girth is connected to the saddle by what is called a latigo which is a long strap on the saddle tree to tighten and fasten the cinch to the saddle. After the saddle is placed on the horse the latigo is used to fasten the cinch and it is pulled up by hand until the proper tightness of the cinch is obtained and the latigo is secured in that position by the tongue of the second ring of the cinch. A flank cinch is typically a leather strap which is connected to flank cinch billets. The flank cinch billets extend from either side of the rear portion of the saddle and the flank cinch passes under the belly of the horse to keep the rear portion of the saddle down and to keep the saddle in place on the horse. The flank cinch enables the rider to more easily stand in the stirrups and is especially useful for roping and competitive events.

The flank cinch is generally kept in position forward on the horses belly and away from its legs by tying the flank cinch to the front cinch with a cinch connector strap. However, a flank cinch and connector strap may cause chafing and a flank cinch often cannot be tightened around the belly of the horse as securely as desired because the horse cannot endure great amounts of pressure in the flank area.

Cinches composed of strands of rope get dirty and stiff, get impacted with dirt and horse hair and become stiff and may guild the horse. Improved cinches utilize a sleeve over the regular stranded rope cinch or nylon webbing such as disclosed in U.S. Pat. No 5,134,836 by Harty. However, the standard rope cinch as well as the improved cinch are used by placing the cinch under the horse's belly and fastened to each side of the saddle, pulling the cinch tight to conform with the horses belly and securing the cinch by buckles. However, all of these cinches depend upon exerting pressure on the horses belly to hold the saddle securely thereto These conventional and improved types of cinches exhibit no "give" and are probably very uncomfortable to the horse and may even restrict his natural breathing. Moreover, the tight cinch are hold the saddle to the horse so tightly that they may restrict the freedom of movement of the horse with respect to the horse's rib cage, shoulders and back. Furthermore, the conventional and improved cinches described heretofore, provide a poor fit and limited security when utilized with horses having low withers, rounded shoulders, or rounded backs, and do not hold the saddle in position very well.

The present invention provides a means for preventing slipping and turning of the saddle on the horse without having to tighten the cinch so tight around the belly of the horse. Moreover, the present invention provides greater freedom of movement of the horse with respect to the horse's rib cage, shoulders, and back, allowing better performance of the horse in pleasure riding, working, and competition events.

The present invention provides an improved cinch which resists lateral shifting when used with any saddle such as shown and described in U.S. Pat. Nos. 5,018,340 and 5,187,924 by Robert L. Marshall hereby incorporated by reference.

It is an object of the present invention to provide a cinch for a saddle for providing a unitary cinch to be used with or without a flank cinch depending upon the needs of the rider.

It is an object of the present invention to provide a cinch which attaches under the rib cage of the horse instead of the flank area of the horse.

It is an object of the present invention to provide a cinch having a skeleton or "rib" of generally rigid reinforcing "U-shaped" material covered with a soft material such as neoprene, padding, leather, or combinations thereof.

It is an object of the present invention to provide a cinch having a generally "U-shaped" support member formed from a single member.

It is an object of the present invention to provide a cinch having two attaching buckles on the exterior surface near the distal ends of the cinch to protect for attachment to the saddle by cinch straps.

It is an object of the present invention to provide a cinch in a preformed shape allowing the horse to breath naturally and to be more comfortable, while keeping the saddle in a secure position on the horse's back.

It is an object of the present invention to provide a cinch which minimizes the need for adjustments.

It is an object of the present invention to provide a cinch which provides maximum stability to the saddle and rider, yet does not restrain the movement of the horse's body.

SUMMARY OF THE INVENTION

The present invention is a saddle cinch contoured to fit a horse's heart girth having a semi-rigid generally "U-shaped" rib support member defining an inner surface and an outer surface, wherein the inner surface is covered by a flexible means of cushioning such as one or more strips of foam rubber. The rib and foam rubber are wrapped with either leather, ("soft glove leather"), or an elastomer material such as neoprene, ("closed cell nitrogen filled to resist moisture). A means of attaching the cinch is provided by securing an attachment means such as a strip of leather backed nylon webbing to the bottom surface of the cinch below the rib whereby buckles can be attached to the ends of the strips for attachment to straps extending from the saddle.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

Figure 1:
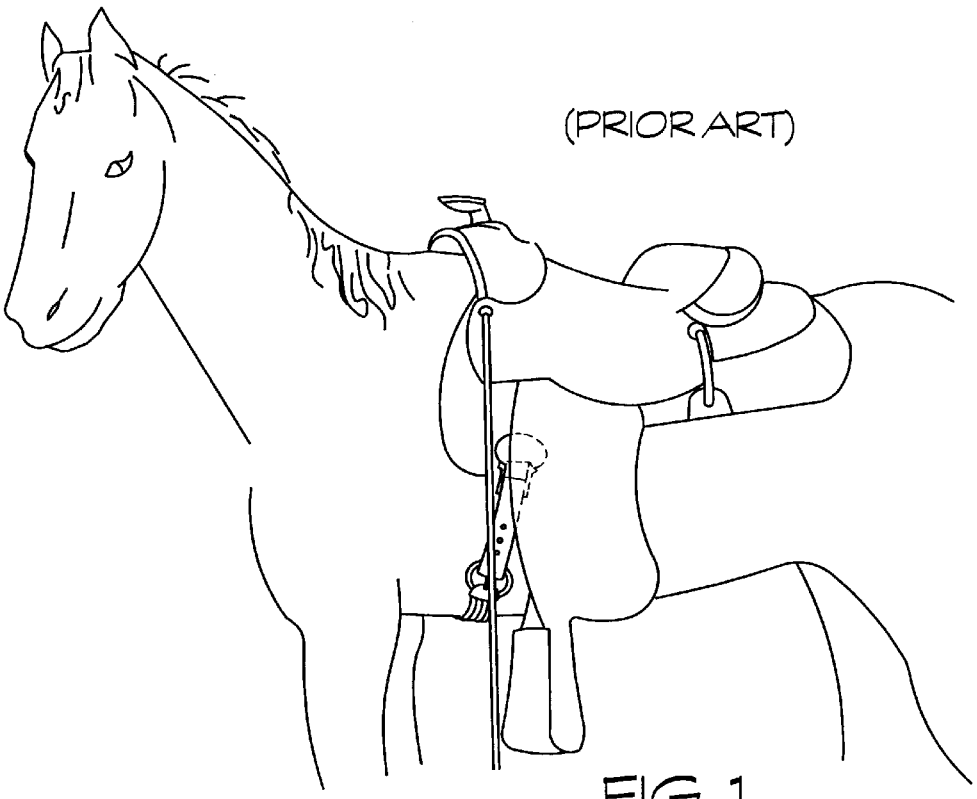
FIG. 1 is a perspective showing a conventional cinch in use holding a saddle onto a horse.

The saddle cinch 10 of the present invention is manufactured from readily available materials and simple in design. The preferred embodiment is comprised of fiberglass, nylon, and leather and/or neoprene.

More particularly, the rib support member 12 of the present invention is comprised of a semi-rigid composite material such as fiberglass molded into a particular shape in which the center is contoured to perfectly fit a horse's heart girth; however, any type of tough polymer or possibly even wood can be shaped to provide a generally rigid support member such as the semi-rigid rib support member 12 as long as the rib 12 retains some of the flexible and pliable character necessary to give the structure rigidity, yet be able "give" and flex with the movement of the horse. A soft cushioning material comprising one or more layers of foam rubber 14 such as neoprene is used as cushioning material. Other polymers, fibrous material, or potentially even an inflatable bladder could be used to provide a cushion between the generally tough, hard rib 12 and the horse. The rib 12 and foam 14 are covered with an outer covering 16 of a soft durable material such as leather, neoprene having a sealed finish, or some other type of tough, durable elastomeric material or polymer to provide a tough outer surface. Both leather and neoprene tend to slide over the surface of the hide of the horse once the horse starts to perspire, whereby the perspiration acts as a natural lubricant between the horse and the outer covering 16. Moreover, a means of attachment such as a fibrous web of material 18, more particularly a strip of nylon, polyester, or other type of web, is attached by sewing and/or gluing onto the exterior surface 20 of the outer covering 16. It is contemplated that other materials of construction may be used with or substituted for the materials of the present invention. The rib support member 12 of the present invention may be incorporated through insertion into a variety of different saddle girths such as described in U.S. Pat. No. 5,125,219 by Sligo; U.S. Pat. No. 5,426,924 by Harty; and U.S. Pat. No. 5,134,836 by Harty; all of which are hereby incorporated by reference.

Figure 2:
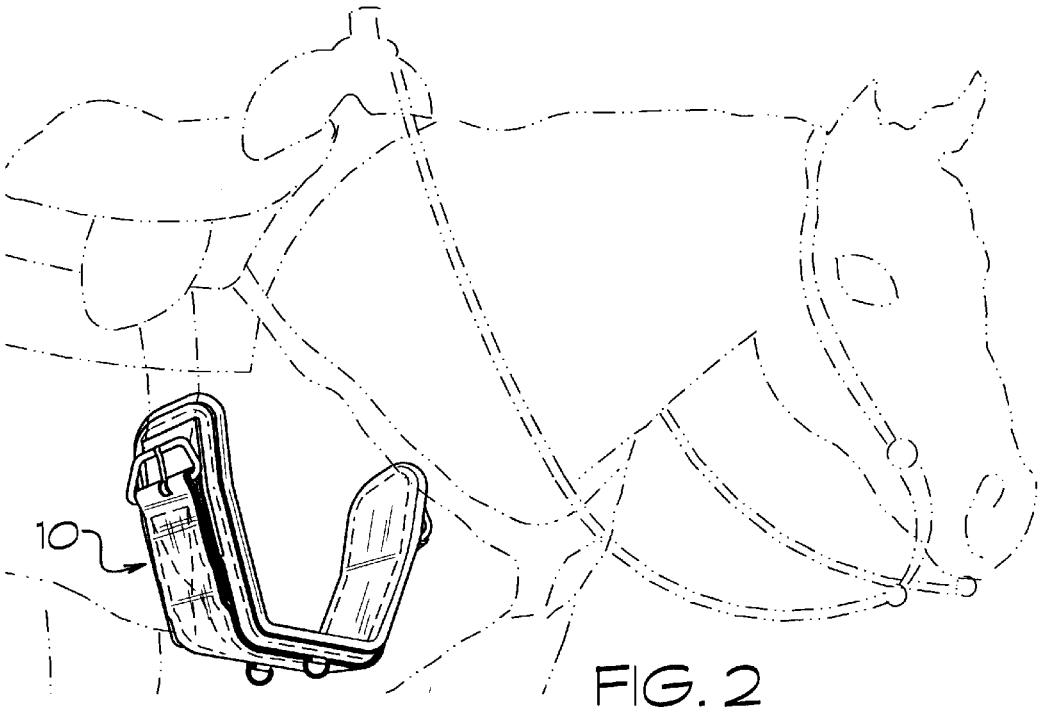
FIG. 2 is a perspective showing the saddle cinch of the present invention in use holding a saddle onto a horse shown in phantom lines.
Figure 4:
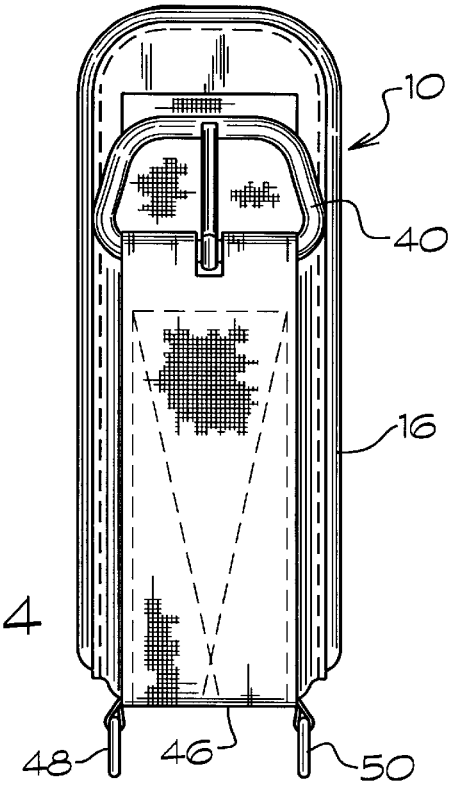
FIG. 4 is a side view of FIG. 3 showing the present invention.
Figure 3:
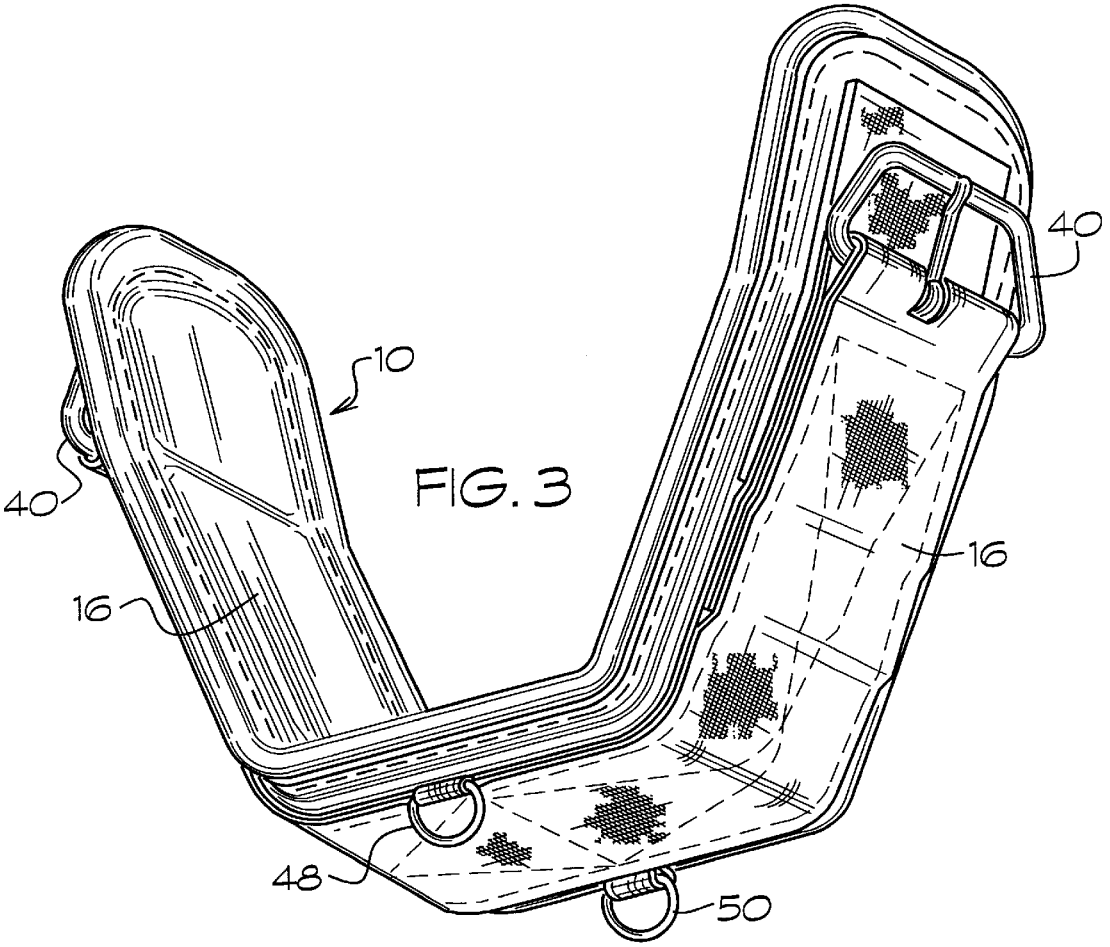
FIG. 3 is a perspective view of a saddle cinch made in accordance with the present invention showing the generally "U-shaped" body covered with soft leather.

With reference now to FIGS. 1 and 2, there is shown in FIG. 1 a horse wearing a saddle secured by a conventional multi-strand rope cinch. FIG. 2 shows the saddle cinch 10 of the present invention securing a saddle to a horse both of which are shown in phantom lines.

With reference to FIGS. 3–9, there is shown one preferred embodiment of the saddle cinch 10 of the present invention. FIGS. 10–14 show the reinforced rib 12 of utilized in all of the embodiments of the present invention.

The integral one piece reinforced rib 12 is formed of a tough, durable, resilient material, easily molded and shaped, and having a generally rigid, yet flexible and pliable structure. The material must resist yielding to the movement of the horse, yet not interfered with the horses movement and have "memory" in order to maintain the integrity of the structure and hold its shape.

Figure 11:
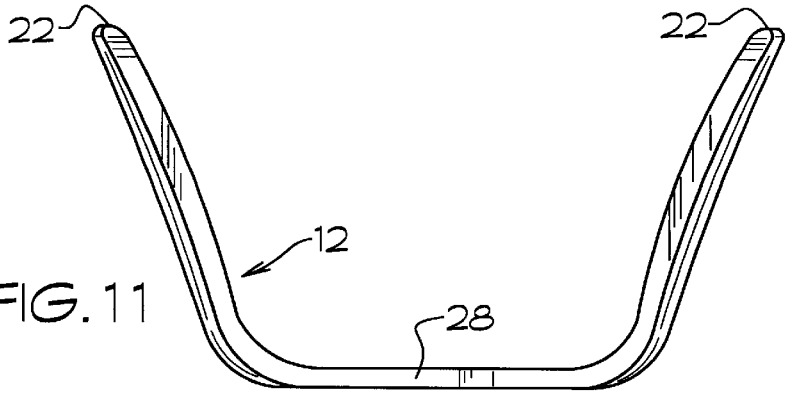
FIG. 11 is a front view of FIG. 10 showing the rib.
Figure 10:
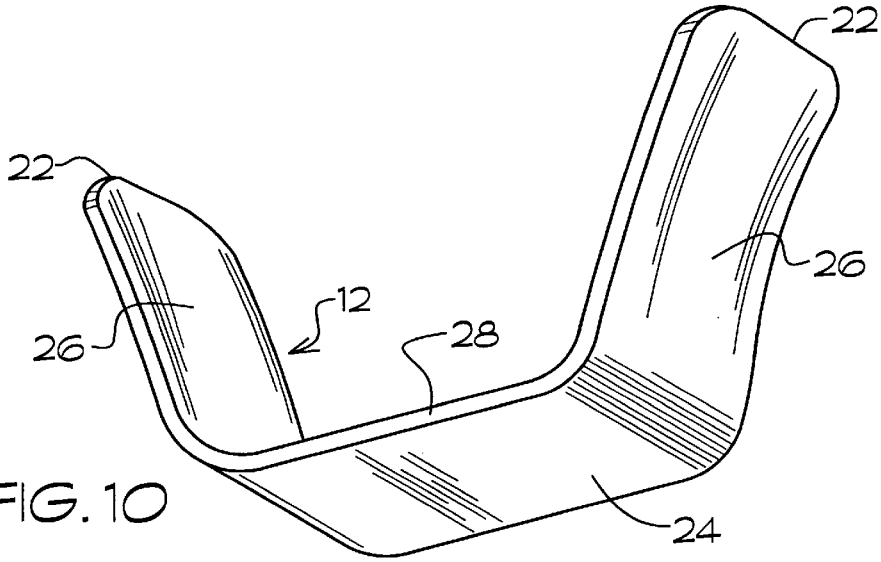
FIG. 10 is a perspective view showing the reinforcement rib of the present invention.

As shown in FIGS. 10–14, the rib 12 comprises a generally "U-shaped" strip of material. The preferred embodiment includes a generally flat central portion 24, and generally flat end portions 26 extending therefrom at an obtuse angle. Of course, it is contemplated that either the central portion 24 or end portions 26 could be rounded or "slightly concave" to provide a form fit to the rib cage of the horse; however, the obtuse angle is essential in order to orient the saddle with respect to the horse. As best shown in FIGS. 10 and 11, the rib 12 includes a front edge 28 and rear edge 30. The rear edge 30 is flared slightly outward with respect to the front edge 28 on both of the end portions 26 of the rib 12 to accommodate the greater breath of the horses rib cage, wherein the narrow front end edge 28 of the rib 12 are narrower and fit nearer horses front legs. As shown in the preferred embodiment, the end portions 26 of the rib 12 are flared, curving slightly outward for to grip the lower side portion of the horse's rib cage and provide lateral support for the saddle. The distal ends 22 of the rib 12 may be tapered slightly providing a thinner cross-sectional area for flexing as much as about ½ of an inch at the extreme distal end 22.

Figure 9:
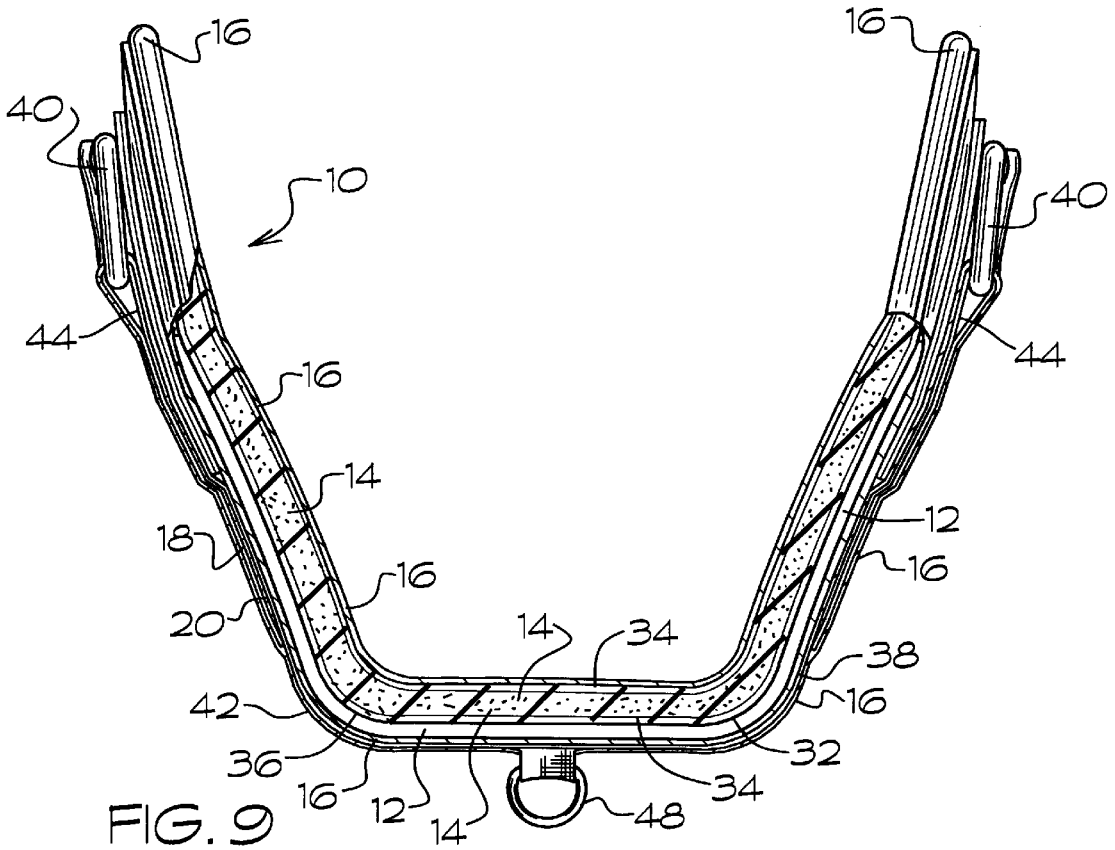
FIG. 9 is a partial cut-away view of FIG. 3 showing the present invention including a least one layer of foam rubber on the top of the rib having leather wrapped over the foam rubber and around the rib, and at least one strip of fibrous material such as a nylon web attached to the exterior surface of the underside of the saddle cinch for securing attachment buckles thereto.
Figure 5:
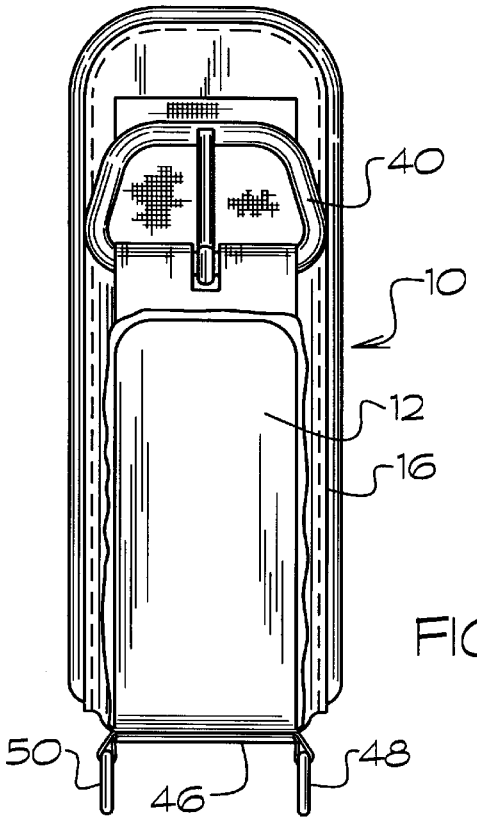
FIG. 5 is a side view of FIG. 3 showing a rib in a partial cutaway view of the present invention.
Figure 6:
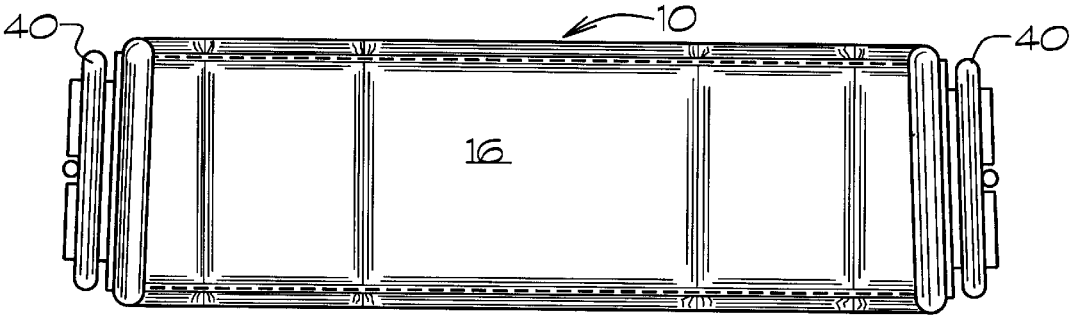
FIG. 6 is a top plan view of FIG. 3 showing the present invention.
Figure 8:
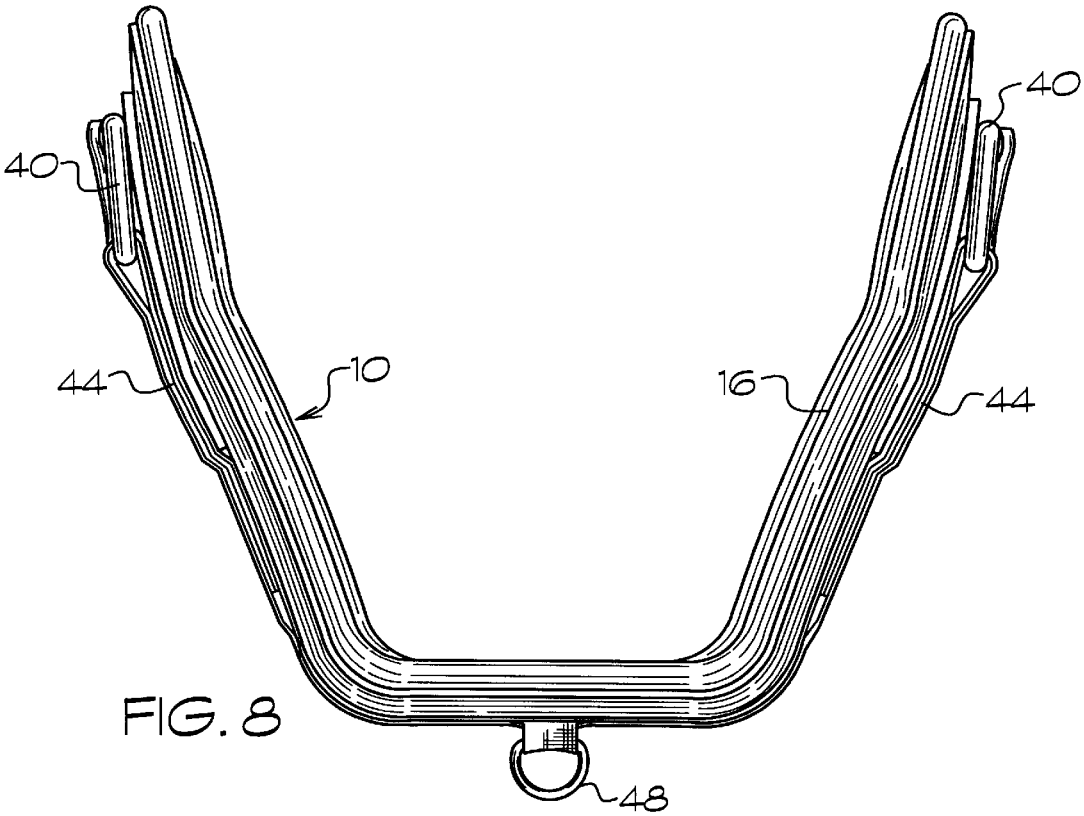
FIG. 8 is a rear plan view of FIG. 3 showing the present invention.
Figure 7:
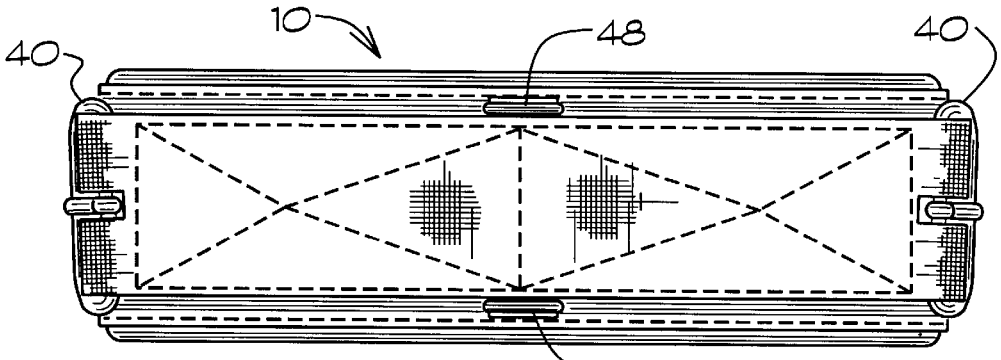
FIG. 7 is a bottom plan view of FIG. 3 showing the present invention.
Figure 14:
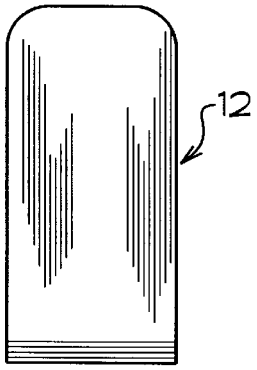
FIG. 14 is a side view of FIG. 10 showing the rib.
Figure 13:
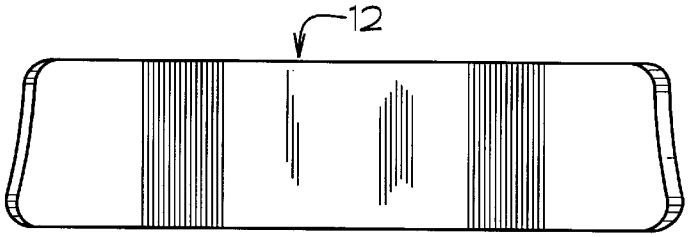
FIG. 13 is a bottom plan view of FIG. 10 showing the rib.
Figure 12:
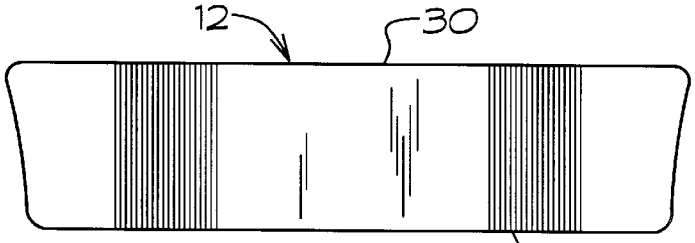
FIG. 12 is a top plan view of FIG. 10 showing the rib.

Construction of the preferred embodiment shown in FIGS. 2–9, is best illustrated in FIG. 9. In the preferred embodiment, a flexible means of cushioning comprises at least one layer of foam rubber 14 cut into a strip and adhered such as by gluing to the inner surface 32 of said rib 12. More particularly, the preferred embodiment utilizes a strip of foam rubber 14 about ¾ of inch in thickness which is placed onto a thin strip of more dense foam rubber 34. The thinner denser strip of rubber 34 is then folded over the foam rubber 14 forming a double ply sandwich having foam rubber 14 in the center and denser foam rubber 34 on the outside. It is contemplated that other elastomer's, rubber, or other natural or synthetic materials in sheets or fibrous material may be substituted for the foam rubber 14 and/or foam rubber 34 to maintain the cushion and resiliency of the padding. A soft leather outer covering 16 is wrapped around the foam rubber 14 and/or 34 attached to the rib 12 and glued to the outer surface 36 of the foam rubber 14, 34, and the exterior rib surface 38. A means of attaching the cinch 10 to a saddle is provided by securing an attachment means such as a strip of nylon web to the bottom surface of the cinch 10 below the rib 12 whereby buckles 40 can be attached to the ends of one or more strips 42 for attachment to straps extending from the saddle. Moreover, the strips 42 may be composed of a flexible material such as a fibrous web of nylon which is attached by an attachment means such as glue to the outer surface of the leather outer covering 16. It is important that the attachment strips 42 be positioned below the rib support member 12 so that the rib 12 is between the attachment strip 42 and the horse. In the preferred embodiment, stitches are sown through the nylon web strip 42, leather outer covering 16, and foam rubber 14, 34 around the outer periphery of the rib 12. As shown in the preferred embodiment the nylon web 44, leather outer covering 16, and foam rubber 14, 34 extend around the outer periphery of the rib 12 and past the distal ends of the rib 12 upwardly at a light obtuse angle to better grip the rib cage of the horse, improve lateral stability, and provide a cushioning means between the buckle 40 and horse. Furthermore, a breast collar ring 48 is attached to the front edge of the central portion 46 of the saddle cinch 10 and a rear cinch ring 50 is attached to the rear edge of the central portion of the saddle cinch 10. It is not necessary to utilize a breast collar or rear cinch with the saddle cinch 10 of the present invention; however, the user is afforded the option.

The preferred embodiment shown in FIGS. 1–9 is especially desired for cutter and barrel racing saddles, but can be used with any saddles.

Figure 15:
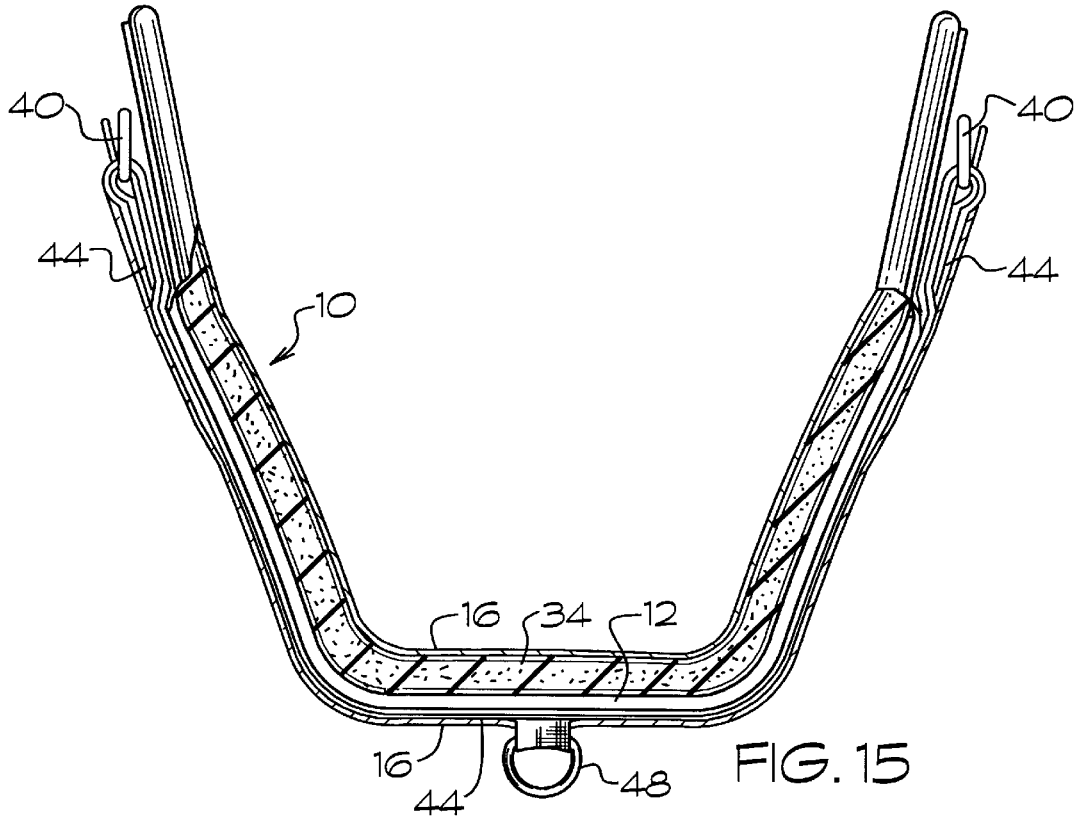
FIG. 15 is front partial cut-away view showing an alternate embodiment of the present invention wherein at least one strip of foam rubber is attached to the inner surface of the rib, a strip of fibrous material such as a nylon web is attached to the exterior surface of the rib, and leather is wrapped over and around the foam rubber and nylon.

FIG. 15 shows another embodiment of the present invention, wherein the means of attachment of the cinch 10 to the saddle comprises a pair of buckles 40 attached to the distal ends of one or more strips of a flexible material such as a fibrous web strip of nylon 44 which is attached by an attachment means such as glue to directly to the exterior rib surface 38 instead of the outer surface of the leather outer covering 16. The leather outer covering 16 is then glued and sewed around the strip of flexible attachment material 44. This construction provides a more aesthetic appearance in that the fibrous web of flexible attachment material 44 is concealed and smaller buckles 40 can be utilized as is sometimes desired for pleasure riding or shows; however, the alternate embodiment may be used with any saddle.

Figure 16:
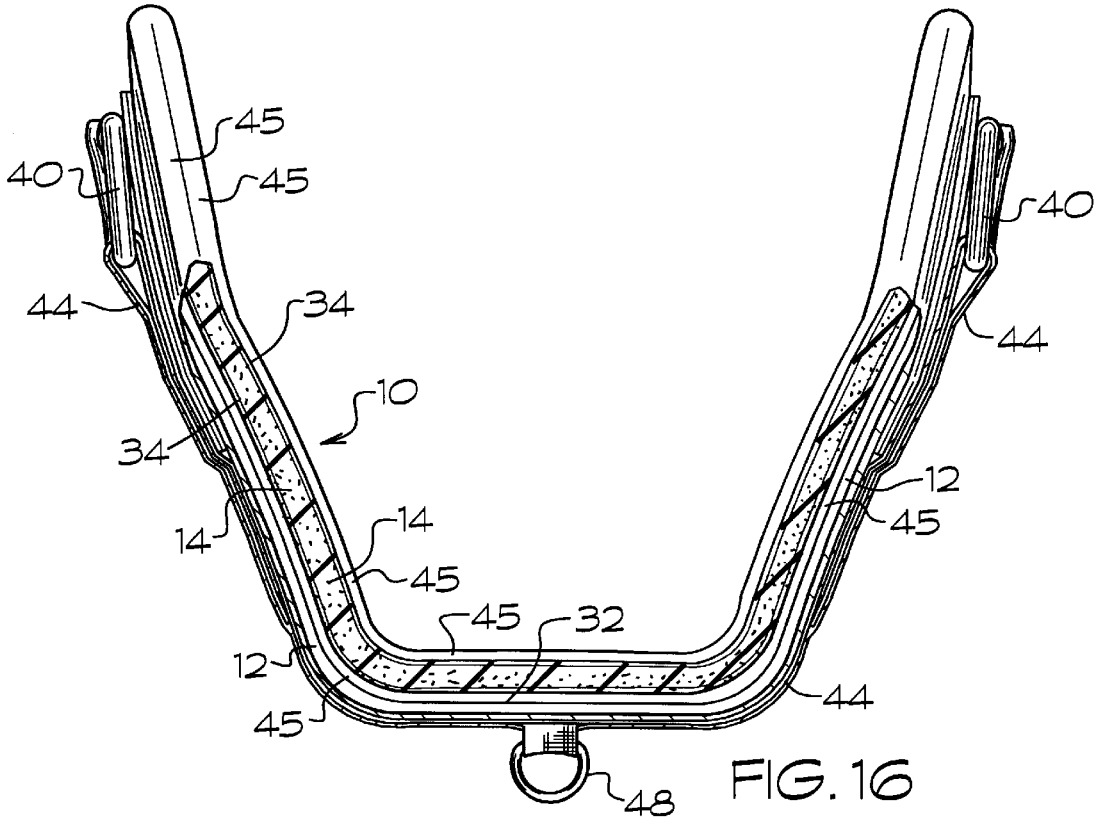
FIG. 16 is front partial cut-away view showing an alternate embodiment of the present invention wherein at least one strip of foam rubber is attached to the inner surface of the rib, a strip of an elastomer material such as neoprene is wrapped over and around the foam and rib, and a strip of fibrous material such as a nylon web is attached to the exterior surface of the rib for securing attachment buckles thereto.

FIG. 16 is another embodiment of the present invention utilizing neoprene in place of leather. Construction of the preferred embodiment shown in FIG. 16 comprises at least one layer of foam rubber 14 is cut into a strip and adhered such as by gluing to the inner rib surface 32. More particularly, the preferred embodiment utilizes a strip of foam rubber 14 about ¾ of inch in thickness which is placed onto a thin strip of more dense foam rubber 34. The thinner denser strip of rubber 34 is then folded over the foam rubber 14 forming a double ply sandwich having foam rubber 14 in the center and denser foam rubber 34 on the outside. It is contemplated that other elastomer's, rubber, or other natural or synthetic materials in sheets or fibrous material may be substituted for the foam rubber 14 and/or foam rubber 34 to maintain the cushion and resiliency of the padding. A layer of tough resilient elastomer, preferably neoprene 45 having a nylon or other web backing, is wrapped around the foam rubber 14 and/or 34 and attached to the inner rib surface 32. The neoprene 45 provides a tough resilient material having a cushioning effect yet providing a sealed finish resistant to dirt and providing a slick surface when lubricated with perspiration from the horse. A means of attachment of the cinch 10 to the saddle comprises a pair of buckles 40 attached to the distal ends of one or more strips of a flexible material such as a fibrous web of nylon 44 which is attached by an attachment means such as glue to the exterior rib surface 38. Stitches may be sown through the nylon web 44, foam rubber 14, 34, around the outer periphery of the rib 12 and neoprene outer covering 45. As shown in the preferred embodiment, the nylon web 44, neoprene outer covering 45, and foam rubber 14, 34 extend around the outer periphery of the rib 12 and past the distal ends of the rib 12 upwardly at a slight obtuse angle to better grip the rib cage of the horse, improve lateral stability, and provide a cushioning means between the buckle 40 and horse. Furthermore, a breast collar ring 48 is attached to the front edge of the central portion of the saddle cinch 10 and a rear cinch ring 50 is attached to the rear edge of the central portion of the saddle cinch 10.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A saddle cinch, comprising:

a generally "U-shaped" rigid reinforcing rib support member defining a having a inner surface and an outer surface, having a preformed shape including a central portion substantially flat along its longitudinal extent and generally flat end portions extending upwardly therefrom at an obtuse angle said rigid reinforcing rib support member having memory to maintain said preformed shape;

a flexible means of cushioning attached to inner surface of said rib support member; and means of attaching said saddle cinch to a saddle.

2. The rigid reinforcing rib support member of claim 1, wherein said end portions have a rear edge flaring slightly outward with respect to a front edge.

3. The rigid reinforcing rib support member of claim 1, wherein said end portions are flared, curving slightly outward for to grip the lower side portion of the horse's rib cage and provide lateral support for the saddle.

4. The rigid reinforcing rib support member of claim 1, wherein said end portions are tapered slightly providing a thinner cross-sectional area for flexing as much as about ½ of an inch at the extreme distal end.

5. The saddle cinch of claim 1, wherein said means of attaching said saddle cinch to a saddle includes means for securing buckles on the exterior surface of said saddle cinch for cooperative engagement with a pair of cinch straps extending from said saddle.

6. The saddle cinch of claim 5, wherein said means for securing buckles on the exterior surface of said saddle cinch to a bottom surface of said saddle cinch is webbing selected from the group consisting of a strip of leather backed nylon, a strip of nylon, and a strip of polyester.

7. The saddle cinch of claim 1, wherein said flexible means of cushioning comprises at least one layer of foam rubber.

8. The saddle cinch of claim 1, wherein said flexible means of cushioning and said rigid reinforcing rib support member are covered with leather.

9. The saddle cinch of claim 1, wherein said flexible means of cushioning and said rigid reinforcing rib support member are covered with an elastomer material.

10. The saddle cinch of claim 1, wherein said elastomer material is neoprene.

11. The saddle cinch of claim 1, wherein said rigid reinforcing rib support member comprises fiberglass.

12. The saddle cinch of claim 1, wherein said rigid reinforcing rib support member is molded into a selected shape whereby the center is contoured to fit a horse's heart girth.

13. The saddle cinch of claim 1, wherein said rigid reinforcing rib support member comprises wood.

14. The saddle cinch of claim 1, wherein said flexible means of cushioning attached to said inner surface of said rigid rib support member is an inflatable bladder.

15. The saddle cinch of claim 1, including a breast collar ring attached to a front edge of a central portion of said saddle cinch.

16. The saddle cinch of claim 1, including a rear cinch ring attached to a rear edge of a central portion of said saddle cinch.

* * * * *